United States Patent [19]

Murphy

[11] Patent Number: 5,069,722

[45] Date of Patent: Dec. 3, 1991

[54] CLEANING ZEBRAMUSSELS FROM WATER PIPES

[76] Inventor: Patrick M. Murphy, 312 Rockwood Dr., Painesville, Ohio 44077

[21] Appl. No.: 548,554

[22] Filed: Jul. 5, 1990

[51] Int. Cl.[5] ..... B08B 9/06; B08B 9/087

[52] U.S. Cl. ..... 134/22.11; 134/22.12; 15/104.05; 15/104.16; 15/104.2

[58] Field of Search ..... 134/22.12, 22.11, 8, 134/7, 42; 15/104.05, 104.2, 104.31, 104.16

[56] References Cited

U.S. PATENT DOCUMENTS

| | | | |
|---|---|---|---|
| 150,164 | 4/1874 | Kacserowsky | 15/104.2 |
| 2,735,122 | 2/1956 | Pletcher | 134/8 |
| 4,244,296 | 1/1981 | Vertut | 15/104.05 |
| 4,337,096 | 1/1982 | Clifford | 134/8 |
| 4,498,932 | 2/1985 | Kruka | 134/8 |

FOREIGN PATENT DOCUMENTS

| | | | |
|---|---|---|---|
| 0570574 | 1/1933 | Fed. Rep. of Germany | 15/104.2 |

OTHER PUBLICATIONS

"Mussel That Clogs Water Systems is Identified in Lake Michigan", Chicago Tribune, Jul. 14, 1990.

"Zebra Mussel A Threat to City, Suburb Water Supply", Chicago Tribune, Jul. 15, 1990, pp. 1, 10.

*Primary Examiner*—Theodore Morris

*Assistant Examiner*—Saud Chaudhry

*Attorney, Agent, or Firm*—Hill, Van Santen, Steadman & Simpson

[57] ABSTRACT

Cleaning of water intake and outfall pipe passage wall incrustation is effected by propelling an incrustation dislodging device along the wall while running fluid through the pipe to flush the dislodged incrustation, which may be collected for disposition at the pipe discharge. A preferred form of the cleaning device comprises a circular stiff wire brush assembly through which the flushing fluid can flow at a greater speed than the propulsion speed of the device. A sea anchor may be used to run propulsion line for the device through the pipe passage. Before effecting operation of the device, a camcorder may be run along the incrusted passage wall for determining the nature of the incrustation.

13 Claims, 2 Drawing Sheets

10
11
12
12a
13
14
15
18
19
20
21
22
23
24
25
28
32
34
37
39
55
57
58
59
60
61
62
63
64
65
67
68
69
70
71
72

CLEANING ZEBRAMUSSELS FROM WATER PIPES

BACKGROUND OF THE INVENTION

The present invention relates to a new and improved water pipe cleaning system, and is more particularly concerned with such a system for cleaning incrustations from water intake and outfall pipes.

Municipal and industrial water systems have intakes and outfall ducts or pipes which are of necessity exposed to open bodies of water, such as lakes. There may be a strong liability of mineral and/or marine creature incrustation of the pipe passages to the detriment of efficient water flow therethrough. In some instances, rust scale may be a problem. In other instances, mineral scale may be a problem. A growing problem in some waters is the proclivity of certain marine animals to attach themselves to the passage walls of the pipes and form undesirable incrustations. A current problem with prolific marine animals identified as zebra mussels is prevalent in Lake Erie, having been imported from foreign source on ship bottoms.

SUMMARY OF THE PRESENT INVENTION

An important object of the present invention is to provide a new and improved cleaning system for intake, and outfall water pipe incrustations, e.g. of the kind that have just been discussed.

Another object of the invention is to provide a new and improved system for cleaning from water intake and outfall pipes flow obstructing incrustations of whatever origin, such as may be caused by rust, by mineral deposits, or by marine animals, such as bivalve mollusks, and in particular zebra mussels.

A further object, ancillary to the foregoing objects, is to provide for the evaluation by observation of the extent of incrustation to assist in efficiently attacking the incrustation problem. Therefore, initially the water pipe walls may be scrutinized for apparent extent of incrustation that should be removed for regaining water flow efficiency.

Cleaning of the pipe passage wall is effected by propelling an incrustation dislodging device along the wall while running water through the pipe to flush the dislodged incrustation, which may be collected for disposition at the discharge end of the pipe.

A particularly advantageous cleaning device comprises a ring-shaped brush through which the water can be drawn while the incrustation cleaning action of the brush is in progress, so that nor only is the dislodged incrustation flushed but the water system dependent on the flow through the pipe can function substantially without interruption while the cleaning device is in operation.

BRIEF DESCRIPTION OF THE DRAWINGS

Other objects, features and advantages of the present invention will be readily apparent from the following description of certain preferred embodiments thereof, taken in conjunction with the accompanying drawings, although variations and modifications may be effected without departing from the spirit and scope of the novel concepts of the disclosure, and in which.

DETAILED DESCRIPTION

Figures 1A, 1B, 2:
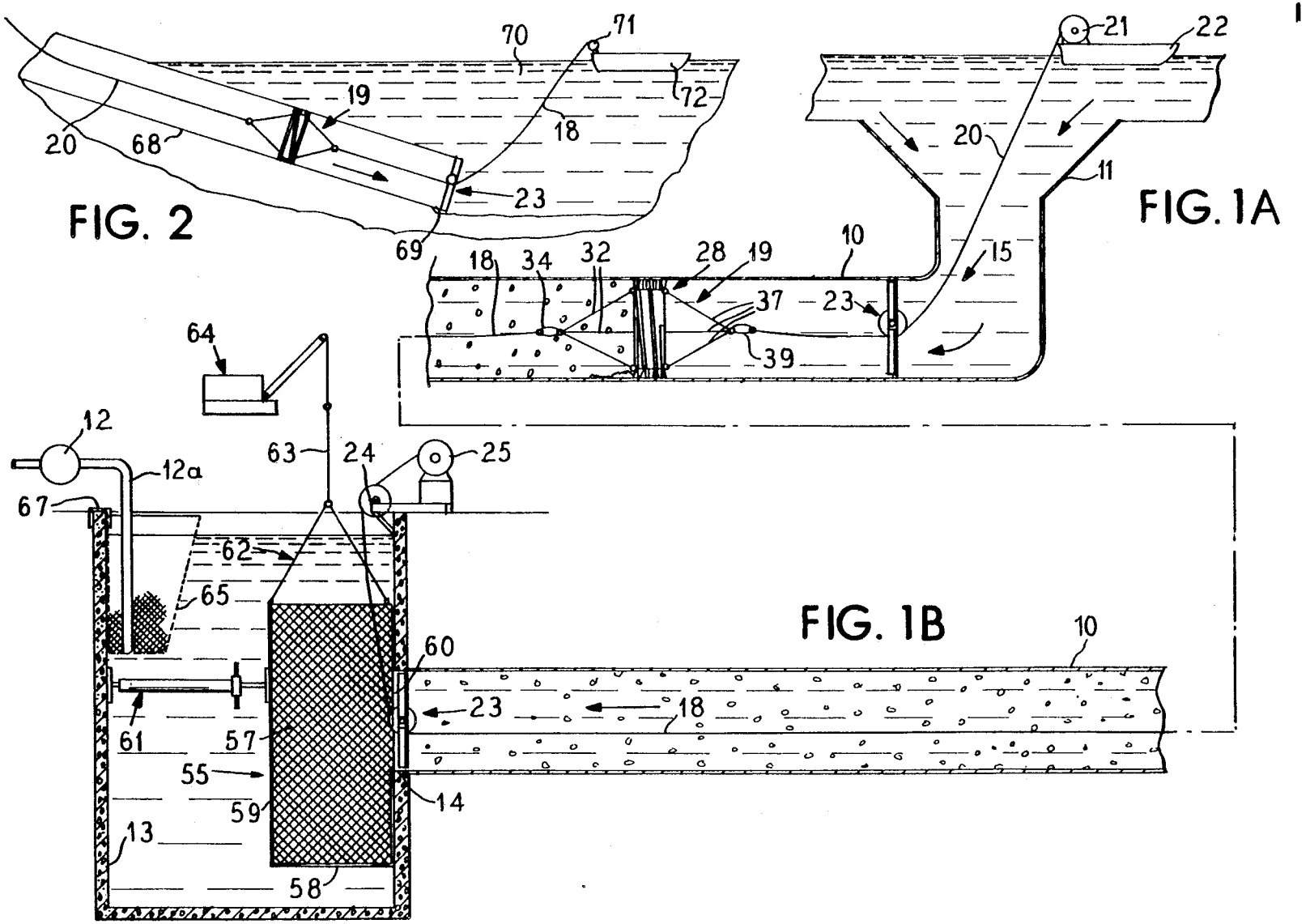
FIGS. 1A and 1B, taken together, represent a more or less schematic water intake pipe and a pipe cleaning system embodying the present invention.
FIG. 2 is a small scale schematic illustration of use of the cleaning system of the present invention in an outfall pipe passage.

Referring to FIGS. 1A and 1B, a water intake pipe 10 is adapted to receive water through an intake funnel 11 under pump suction effected by a pump 12 in a water supply line **12*a* having an inlet within a raw water well 13 into which the water is drawn from the discharge end of the pipe 10 delivering through an intake port 14** in a wall of the well.

Figure 7:
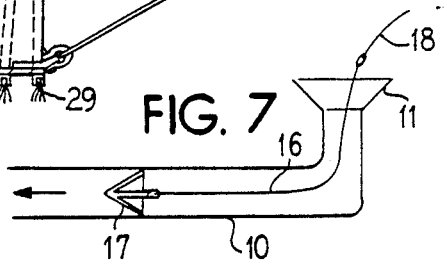
FIG. 7 is a schematic illustration showing how a sea anchor may be used to lead a cleaning device cable through the pipe passage to be cleaned.

For large volume water supplies the pipe 10 and the well 13 may be of a size large enough to permit a diver to enter the same for inspection purposes and to install equipment, such as incrustation cleaning equipment 15 embodying the present invention. As a preliminary to such installation, a pull-in line 16 (FIG. 7) may be drawn through the intake funnel 11 into the pipe 10 by means of a sea anchor 17. In-flowing water, designated by directional arrow, causes the sea anchor to advance through the pipe 10 so that the line 16 draws a cleaning device motivating cable 18 through the pipe. Attached to the cable 18 is a pipe cleaning device 19 which pulls in after itself a rope or cable safety line 20 paid out from a winch 21 that may be carried by a work boat or barge 22 on the body of water supplying the intake. A first guide pulley assembly 23 near the inlet into the pipe 10 is desirably provided for guiding the line 20 into the pipe 10.

The cable 18 is drawn by the sea anchor 17 under in-flowing water propulsion to the well 13. There the cable 18 is trained over a second pulley assembly 23 at the intake port 14 and directed upwardly to and over a guide pulley 24 mounted on top of the well wall. From the pulley 24, the cable runs to and is attached to a power winch 25 which is operable to drive the cable 18 for pulling the cleaning device 19 toward the port 14

Figure 4:
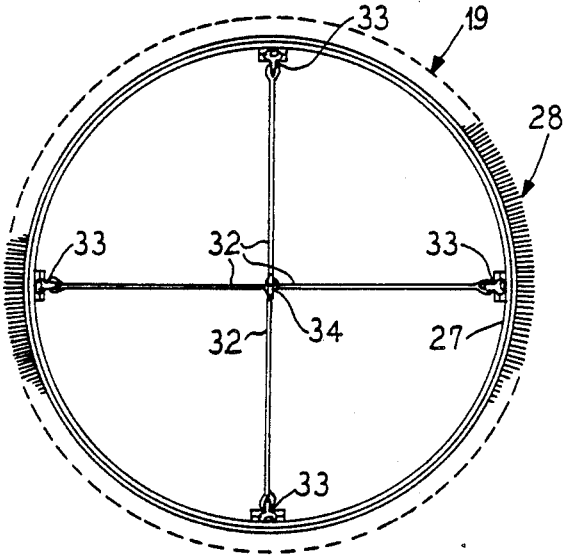
FIG. 4 is an end elevational view of the cleaning brush device shown in FIG. 3.
Figure 3:
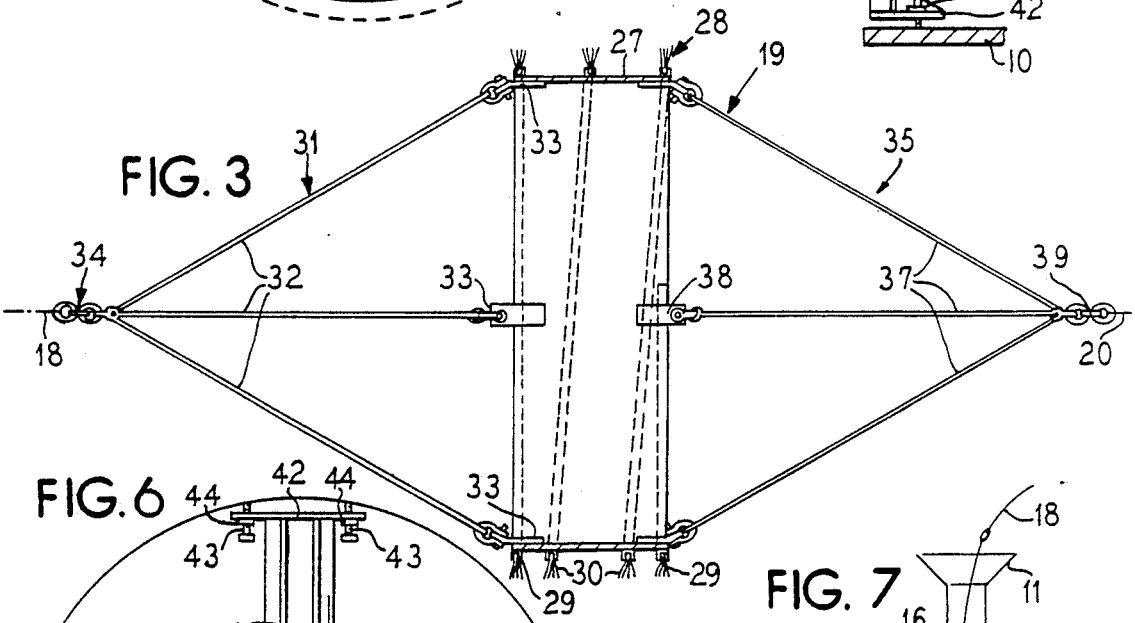
FIG. 3 is a substantially enlarged view of the cleaning brush device which is shown on a smaller scale in FIGS. 1A and 2.

For preferred details of the cleaning device 19, reference is made to FIGS. 3 and 4. As a body for the device 19, there is provided a stiff ring 27 of suitable length and a diameter sufficiently less than the inside diameter of the pipe 10 to accommodate an incrustation dislodging stiff wire brush assembly 28 about the outside diameter of the body ring 27. At the opposite ends of the body ring 27, the brush assembly 28 may comprise respective ring-shaped wire brushes 29 welded to the body ring 27. Between the ring-shaped brushes 29 an open wound spiral coil wire brush 30 is welded to the body ring 27. The brushes 29 and 30 are preferably of an equal outside diameter such as to effect thorough brushing, scrapping off of incrustation as the cleaning device 19 is drawn through the pipe being cleaned.

For attachment of the cable 18, a bridle 31 comprising a plurality of strands 32, herein four, are respectively attached equidistantly about the leading, downstream edge of the body ring 27 as by means of respective attachment brackets 33. The bridle strands 32 converge downstream and are attached at their leading ends to a swivel coupling 34 to which the cable 18 is attached. At the other upstream or trailing end of the ring body 27, a similar bridle 35 having four equidistantly spaced strands 37 is attached to the adjacent end of the ring body 27 by means of attachment brackets 38 similar to the brackets 33. The convergent upstream ends of the strands 37 are attached to a swivel coupling 39 connected to the leading end of the line 20.

Figure 5:
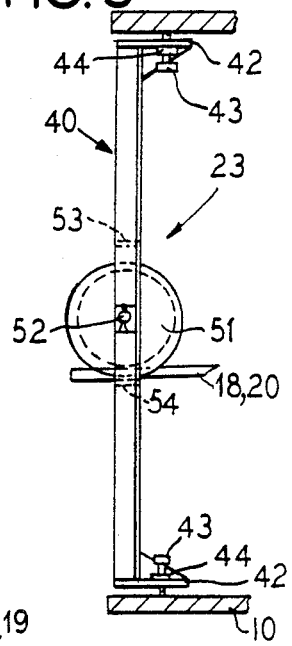
FIG. 5 is an enlarged depiction of one of the guide pulley assemblies shown in FIGS. 1A, 1B and 2.
Figure 6:
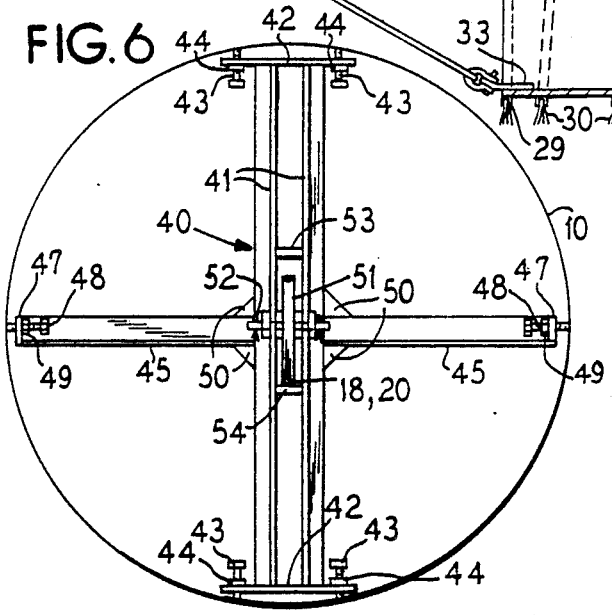
FIG. 6 is an end elevational view of the guide pulley assembly in FIG. 5.

Each of the pulley assemblies 23 desirably comprises a generally cruciform frame 40 (FIGS. 5 and 6) comprising a vertical post having spaced parallel bars 41 secured at their upper and lower ends to respective plates 42 through which are threaded shaped end bolts 43, that act like set screws for retainingly engage the wall of the pipe 10 and are locked against unintentional backing off by means of lock nuts 44. Lateral arms 45 of the frame 40 have distal end plates 47 through which are threaded securing bolts 48 functioning similar to set screws by engaging the wall of the pipe 10, and are locked against unintentional release by means of lock nuts 49. Thereby, the frame 40 is adapted to be thoroughly releasably secured in desired position within the pipe 10. The post assembly 41 and the arms 45 have their junctures reinforced by means of triangular gussets 50.

Each of the frames 40 has a pulley 51 located between the vertical post bars 41 on an axle 52 having its axes generally aligned with the arms 45. Spaced adjacently above the pulley 51 is a transverse stiffener 53 secured to and between the post bars 41. Closely adjacently below the pulley 51 is a similar transverse stiffener member 54 secured to and between the post bars 41 and close enough to the rotary pulley 51 to retain the guide line 20 within the groove of the pulley of the first pulley assembly 23, and for holding the cable 18 in the groove of the pulley 51 of the second pulley assembly 23.

With the cleaning device 19 and the guide pulley assemblies 23 operatively installed, and the raw water caused to flow under in-flow pressure through the intake pipe 10, and past and through the ring-shaped pipe cleaning device 19, the device 19 is pulled by means of the cable 18 from adjacent the pipe inlet through the intake pipe 10 at a speed which will effectively dislodge incrustation of whatever. The dislodged incrustation will be flushed downstream from the cleaning device 19. It is contemplated that the cleaning device 19 may be advanced at about five feet per minute which will permit the stiff brush assembly 28 to function with maximum pipe wall cleaning efficiency. Flushing of the loosened incrustation will thus occur efficiently by virtue of the generally more rapidly flowing water into the pipe. If the incrustation is particularly resistant to being scrapped off by the brush assembly 28, a generally back and forth motion may be imparted to the cleaning device 19 either from end-to-end of the intake pipe 10 or by progressive stages.

As the loosened incrustation debris is flushed into the raw water well 13 from the intake port 14, the debris is desirably captured in a collection basket 55 (FIG. 1B). This basket may be of substantially rectangular form with vertical small mesh screen walls 57 and a bottom wall 58 supported by a stiff frame 59. An intake port 60 in one of the vertical walls 57 is aligned with the intake port 14 in the wall of the well 13. Screw jack means 61 retain the collection basket 55 removably in place. Periodically the collection basket 55 may be raised and cleaned out by disengaging the jack 61 and lifting the basket from the well 13 as by means of a bridle 62 attached to the upper open end of the basket and connected to a lifting line cable 63 operated by a suitable lifting means 64 such as a power crane, or the like. If it is not feasible to use the collecting basket 55, the incrustation debris may be collected in the bottom of the well 13 which may from time to time be cleaned out by suitable mechanical or suction dredging means.

To prevent particulate incrustation debris being drawn into the water supply line **12*a*, a fine mesh protective screen 65 may be provided between the interior of the well 13 and the inlet into the water supply line 12*a*. If desired, the screen 65 may be of generally basket form and provided with bracket means 67 for removable support at the top of the well 13**.

Figure 8:
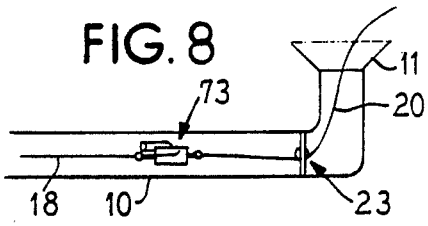
FIG. 8 is a small scale schematic view showing how a camcorder is adapted to be run through a pipe passage to be cleaned for scrutinizing and recording an incrustation condition.

Referring to FIG. 2, the cleaning system of the present invention is also adapted for removing incrustations from the passage of an outfall pipe 68 which may of necessity have its discharge end 69 located within a body of water 70 from which marine animals, such as zebra mussels, may contaminate the outfall pipe passage. For this purpose, the operating direction of the cleaning device 19 will be in the outfall water flow direction as indicated by the directional arrow. The cable 18, for this purpose, will be guided by one of the pulley assemblies 23 at the discharge end 69 and pulled by a winch 71 which may be mounted on a service boat or barge 72.

Where it may not be feasible to effect a reasonably accurate diver-observation report on the incrustation condition within either the intake pipe 10 or the outfall pipe 68, a camcorder 73 (FIG. 8) may be attached between the lines 18 and 20 and drawn through the incrusted passage within the pipe, and the observation record produced by the camcorder studied to determine the most effective structure of the cleaning device 19 and more particularly of the incrustation dislodging means such as the brush assembly 28. For some purposes, the length of the brush assembly may need to be longer and with a greater concentration of the brushes 29 and 30 than for less densely or thickly incrusted conditions. From an economy standpoint, both with respect to equipment and power requirements, the shortest brush assembly that will serve the purpose would desirably be used. Use of the camcorder 73 can therefore be fairly cost effective.

It will be understood that variations and modifications may be effected without departing from the spirit and scope of the novel concepts of the present invention.

I claim as my invention:

1. A method of cleaning and disposing of zebra mussels incrustation from a passage wall within a water pipe having one end immersed in a zebra mussel infested body of water, comprising:

dislodging the zebra mussels incrustation from the passage wall;

running flushing water through the pipe and discharging the water and the dislodged zebra mussels incrustation from the pipe into a porous collecting basket;

collecting the dislodged incrustation in the basket and separating the water from the basket through its porosity; and from time-to-time removing the basket and clearing the collected dislodged incrustations from the basket.

2. A method according to claim 1, which comprises providing said basket as a removable container located in a receiving well within which the water discharged from the basket is received.

3. A method according to claim 2, which comprises discharging said incrustation from said water pipe through a port into said well and into said basket.

4. A method according to claim 2, comprising rescreening the water received in the receiving well, from said basket and withdrawing the thus rescreening water from the well.

5. A method according to claim, comprising advancing a dislodging device along said passage wall toward said basket, and running a flushing water stream ahead of said device for clearing dislodged incrustation from in front of the advancing device and toward and into said basket.

6. A method according to claim 1, comprising effecting said dislodging of the incrustation mechanically.

7. An arrangement for cleaning and disposing of zebra mussels incrustation from a passage wall within a water pipe having one end immersed in a zebra mussels infested body of water, comprising:

means for dislodging the zebra mussels incrustation from the passage wall within the pipe;

means for running flushing water through the pipe for flushing the dislodged zebra mussel incrustation from the pipe;

a porous collecting basket for receiving the flushing water and the dislodged zebra mussels incrustation flushed from the pipe so that the flushing water will discharge from the basket and the discharged mussels incrustation will remain in the basket; and means for removing the basket from time-to-time for cleaning the dislodged mussels incrustations from the basket.

8. An arrangement according to claim 7, comprising a receiving well in which said basket is located and which will receive the water discharged from the basket.

9. An arrangement according to claim 8, wherein said well has a wall, and a port through said wall into said basket.

10. An arrangement according to claim 8, comprising means for rescreening the water received in the well, for the basket and means for withdrawing the rescreening water from the well.

11. An arrangement according to claim 7, comprising means for advancing a dislodging means through said passage toward said basket, and means for causing the flushing water to run as a stream ahead of said dislodging means for clearing dislodged incrustation from in front of the advancing dislodging means and toward said basket.

12. An arrangement for cleaning and disposing of zebra mussels incrustation from a passage wall within a water pipe having one end immersed in a zebra mussel infested body of water, comprising:

means for dislodging the zebra mussels incrustation from the passage wall within the pipe;

means for running flushing water through the pipe for flushing the dislodged zebra mussel incrustation from a discharge end of the pipe;

said means for dislodging comprising a ring-shaped member carrying stiff brush means on its periphery for effecting mussels incrustation dislodgement as the ring-shaped member is moved within the pipe;

at least one end of said ring-shaped member having a bridle attached thereto;

a flexible line attached to said bridle;

means to which the line is attached for drawing the line and ring-shaped member in incrustation-dislodging manner through the pipe;

a guide pulley means along which the line runs;

a cruciform pulley frame for supporting said guide pulley means; and means for detachable securing said frame to the inside of said pipe.

13. An arrangement according to claim 12, wherein said ring-shaped member has a second bridle attached to its opposite end, a control line attached to said second bridal, means for operating said control line, a second guide pulley means along which said control line runs, a second cruciform pulley frame for supporting said second pulley means, and means, for removably attaching said second frame within said pipe.

* * * * *